US009036455B2

(12) United States Patent
Kato et al.

(10) Patent No.: US 9,036,455 B2
(45) Date of Patent: May 19, 2015

(54) ELECTRONIC TIMEPIECE

(71) Applicant: Seiko Instruments Inc., Chiba (JP)

(72) Inventors: Kazuo Kato, Chiba (JP); Akira Takakura, Chiba (JP); Tomohiro Ihashi, Chiba (JP); Takanori Hasegawa, Chiba (JP); Toshitaka Fukushima, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 162 days.

(21) Appl. No.: 13/738,059

(22) Filed: Jan. 10, 2013

(65) Prior Publication Data

US 2013/0194896 A1 Aug. 1, 2013

(30) Foreign Application Priority Data

Jan. 30, 2012 (JP) ..... 2012-017052

(51) Int. Cl.
*G04G 19/06* (2006.01)

(52) U.S. Cl.
CPC ..... *G04G 19/06* (2013.01)

(58) Field of Classification Search
USPC ..... 368/64, 66, 204, 205
See application file for complete search history.

(56) References Cited

U.S. PATENT DOCUMENTS

| | | | | |
|---|---|---|---|---|
| 5,886,954 | A | 3/1999 | Asami et al. | 368/67 |
| 6,463,010 | B1 * | 10/2002 | Nakamiya et al. | 368/64 |
| 6,636,459 | B1 * | 10/2003 | Nagata | 368/204 |
| 6,898,156 | B1 * | 5/2005 | Nakamiya et al. | 368/204 |
| 7,660,975 | B2 * | 2/2010 | Nakamura et al. | 713/1 |
| 2001/0028606 | A1 * | 10/2001 | Fujisawa | 368/204 |
| 2003/0146736 | A1 * | 8/2003 | Kosuda et al. | 320/132 |
| 2010/0061193 | A1 * | 3/2010 | Kasuo et al. | 368/204 |
| 2010/0165797 | A1 * | 7/2010 | Asami et al. | 368/204 |
| 2010/0182880 | A1 * | 7/2010 | Asami et al. | 368/204 |
| 2011/0199865 | A1 * | 8/2011 | Ogasawara | 368/66 |
| 2012/0057438 | A1 * | 3/2012 | Shimizu et al. | 368/204 |
| 2012/0287760 | A1 * | 11/2012 | Ogasawara et al. | 368/80 |
| 2012/0307598 | A1 * | 12/2012 | Hasegawa | 368/66 |

* cited by examiner

*Primary Examiner* — Amy Cohen Johnson
*Assistant Examiner* — Matthew Powell
(74) *Attorney, Agent, or Firm* — Adams & Wilks

(57) ABSTRACT

An electronic timepiece is operated with a power-supply voltage from a secondary battery charged with a voltage from a solar panel. An oscillation circuit generates and supplies a clock signal to a CPU when the voltage charged to the battery is lower than a first voltage. A reset circuit resets the CPU when the voltage charged to the battery does not exceed a second voltage higher than the first voltage, and cancels the reset of the CPU when the voltage charged to the second battery exceeds the second voltage. The CPU starts an operation when the voltage charged to the secondary battery exceeds the second voltage and the reset is cancelled, and performs a time-of-day display on a display unit when the voltage charged to the secondary battery is equal to or higher than a third voltage higher than the second voltage.

12 Claims, 6 Drawing Sheets

PS:POWER SAVE

CHARGE:CHARGE
(CHARGING NEEDED))

FIG. 4

| CHARGED STATE OF BATTERY | INDICATION OF REMAINING AMOUNT OF BATTERY | TIME-OF-DAY DISPLAY | SECONDARY BATTERY VOLTAGE (Vdd) | OPERATION OF OSCILLATING CIRCUIT | RESET SIGNAL | CPU OPERATION |
|---|---|---|---|---|---|---|
| H (SUFFICIENT) | | ○ | 2.5V～2.6V (FULLY CHARGED) | ↑ | ↑ | OPERATION |
| M (MEDIUM) | | ○ | 2.3V～2.5V | | | |
| L (LOW) | | ○ | 2.2V～2.3V | | | |
| LL1 (EXTREMELY LOW) | NON-DISPLAY, POWER SAVE MODE | × | 1.7V～2.2V OR BELOW | | | |
| LL2 | NON-DISPLAY, POWER SAVE MODE | × | 1.2V～1.7V | OPERATION | CANCEL | |
| LL3 | INOPERABLE | × | 0.9V～1.2V | START | RESET | RESET (HARD CONTROL) |
| LL4 | INOPERABLE | × | 0V～0.9V | STOP | RESET | |
| 132 | DISPLAY DRIVER | | 115 | OSCILLATION CIRCUIT | BOR CIRCUIT | 114 |

CHARGE COMPLETED

START CHARGING

ELECTRONIC TIMEPIECE

BACKGROUND OF THE INVENTION

1. Technical Field

The present invention relates to an electronic timepiece provided with a solar panel.

2. Description of Related Art

Electronic equipment such as an electronic clock is disclosed in the related art (for example, see JP-A-2002-186186). The electronic equipment described in JP-A-2002-186186 is configured to prohibit display when a power voltage is lowered and reaches a first voltage, perform an initializing process when the power voltage reaches a second voltage lower than the first voltage, and then restart the display when the voltage is restored and reaches a third voltage (>first voltage).

Electronic equipment with a power generating apparatus is also disclosed in the related art (for example, see Japanese Patent No.3738334). The electronic equipment described in Japanese Patent No.3738334 is provided with an all clear circuit configured to start an output of an all clear signal to an LSI when the power voltage is at a voltage level slightly higher than a lower limit of an LSI action for a timepiece, and then, after the power voltage has reached an oscillation start voltage higher than the lower limit of the action voltage, continue the output of the all clear signal until a certain period has elapsed.

Incidentally, in the electronic timepiece in the related art, an illuminance of a solar panel is low (for example, 500 lx), and if a start of oscillation and a time-of-day display are performed simultaneously from immediately after a release of reset of a CPU when restoring a secondary battery from a vacant state to a completely charged state in a state in which a generated current in the solar panel is low, a consumed current required for activation may exceed the generated current of the solar panel. Therefore, in the electronic timepiece, there may be a case where actions of "start oscillation and release CPU reset→lowering of battery voltage→reset CPU→increase in battery voltage by power generation→start oscillation and release CPU reset→lowering of battery voltage . . . " are repeated and hence the secondary battery cannot be restored normally and hence cannot be charged.

SUMMARY OF THE INVENTION

It is an aspect of the present application to provide an electronic timepiece capable of restoring a secondary battery in an uncharged state or a low charged state to a normal charged state smoothly and reliably restoring the electronic timepiece from an action stopped state to a normally operating state even in a case where a generated current from a solar panel is not sufficient as a case where the electronic timepiece is under a fluorescent lighting conditions.

An electronic timepiece according to another aspect of the application is configured to be operated by power supplied from a secondary battery charged by a generated voltage from a solar panel configured to generate power upon reception of light, wherein according to a voltage of the secondary battery, the electronic timepiece has a predetermined operation start voltage at which the electronic timepiece is activated and starts an operation and, and a predetermined display start voltage at which the electronic timepiece starts a display action on a display unit, and the operation start voltage is set to be lower than the display start voltage.

The electronic timepiece according to another aspect of the application may be configured to include: a CPU configured to control time counting and the display action of the electronic timepiece; an oscillating circuit configured to generate a clock signal and supplies the generated clock signal to the CPU when the voltage of the secondary battery is equal to or higher than a predetermined first voltage; a reset circuit configured to reset the CPU when the voltage of the secondary battery is equal to or lower than a predetermined second voltage higher than the first voltage, and cancel reset of the CPU when the voltage of the second battery exceeds the second voltage; the display unit configured to perform display upon reception of a supply of the power from the secondary battery; and a battery voltage detection circuit configured to detect a voltage value of the secondary battery and output the detected voltage value to the CPU, wherein the CPU is configured to start an operation when the voltage of the secondary battery exceeds the second voltage and the reset is cancelled and performs a time-of-day display on the display unit when the voltage of the secondary battery is equal to or higher than a predetermined third voltage higher than the second voltage.

The electronic timepiece according to another aspect of the application may be configured such that the CPU extinguishes the time-of-day display on the display unit and displays an indication notifying the secondary battery needs to be charged on the display unit when the secondary battery voltage reaches or exceeds a predetermined fourth voltage which is a voltage between the second voltage and the third voltage and is lower than the third voltage.

The electronic timepiece according to another aspect of the application may be configured such that the CPU displays the time-of-day display and an indication of a remaining amount of battery according to the voltage value of the secondary battery when the voltage of the secondary battery is equal to or higher than the third voltage.

The electronic timepiece of the application sets an operation start voltage at which the electronic timepiece is activated and starts an operation to be lower than a display start voltage at which the display action in the display unit is started.

Accordingly, the present invention provides an electronic timepiece which is capable of restoring a secondary battery in an uncharged state or a low charged state to a normal charged state smoothly and reliably restoring the electronic timepiece from an operation stopped state to a normally operating state even though a generated current from the solar panel is insufficient is provided.

BRIEF DESCRIPTION OF THE DRAWINGS

FIG. 4 is a drawing for explaining states of actions of respective parts according to a charged state of a secondary battery of the first embodiment;

DESCRIPTION OF THE PREFERRED EMBODIMENTS

Figure 1A:
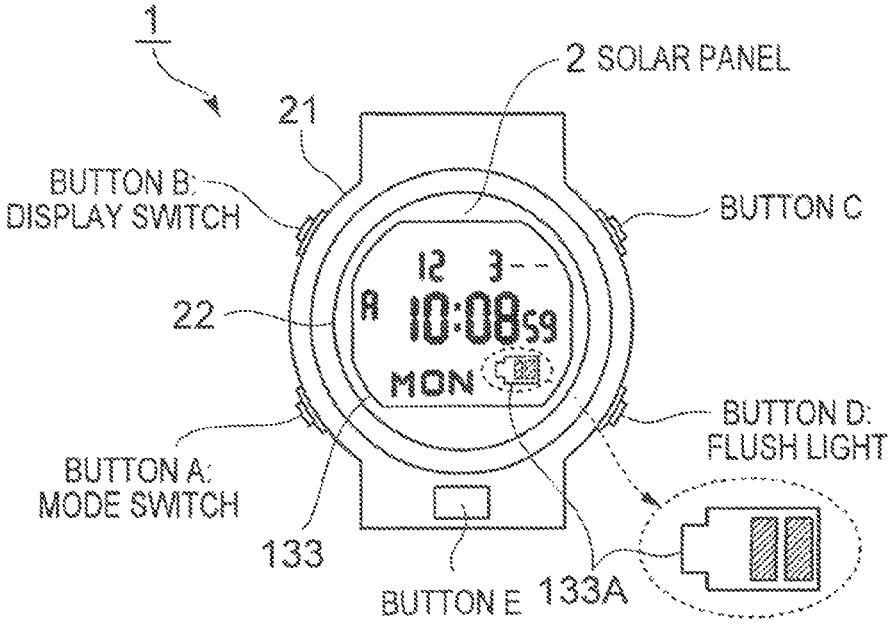
FIGS. 1A to 1D are a drawing illustrating an overview of an electronic timepiece.

Referring now to drawings, an embodiment of the invention will be described below.

First Embodiment

Overview of Electronic Timepiece

FIG. 1 is a drawing illustrating an overview of an electronic timepiece according to a first embodiment of the invention.

As illustrated in FIG. 1, an electronic timepiece 1 of the embodiment includes a body case 21, and an LCD (liquid crystal display) 133 and a solar panel 2 under a transparent plate 22 such as a rectangular-shaped windshield glass or the like chamfered at four corners on a front side of the body case 21. The LCD 133 is provided at a center of the transparent plate 22. The solar panel 2 is arranged in a periphery of the transparent plate 22 so as to surround the LCD 133 in plan view.

An operating button A, an operating button B, an operating button C, and an operating button D which may be operated by a user are provided on a side surface of the body case 21. An operating button E is provided on a front surface of the body case 21.

The operating button A outputs a mode change signal, which is a signal for changing an action mode of the electronic timepiece 1. Every time when the operating button A is pressed, the mode change signal is output to a mode controller 104 (see FIG. 2) in a CPU 101, described later. The mode controller 104 transfers the mode of the electronic timepiece 1 to a time-of-day display mode, a chronograph mode, a timer mode, and an alarm mode in sequence in response to the mode change signal as illustrated in FIG. 1B, and the mode controller 104 transfers the electronic timepiece 1 to a power save mode under predetermined conditions, described later.

Figure 1B:
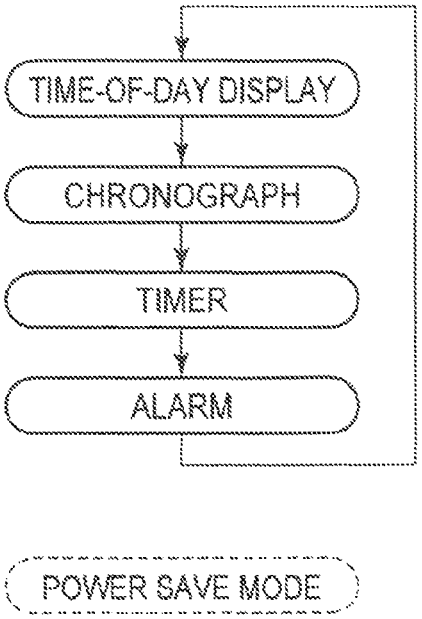

Here, the time-of-day display mode is a mode in which normal time-of-day display is performed, for example, date, current time-of-day, and day of the week displayed on the LCD 133 as illustrated in FIG. 1A.

The chronograph mode is a mode used for time measurement of a record in a sport event or the like and display thereof and, for example, is a mode measuring and displaying a lap time and a split time.

The timer mode is a mode in which a timer is set for a timer time in advance, and time is measured by counting down the time set to the timer and an alarm sound is given at a count "zero". The alarm mode is a mode in which time-of-day is set in advance, and the alarm sound is given when the measured time-of-day reaches the set time.

Figure 1C:
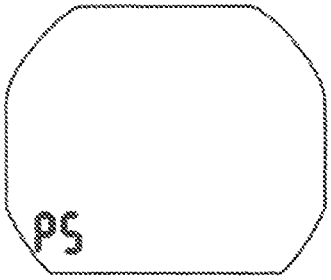

The power save mode is a mode in which when a state in which no light is incident on the solar panel 2 continues for more than a certain period, the displays on the LCD 133 are extinguished in order to prevent the useless power consumption of a secondary battery. In this power save mode, the electronic timepiece 1 displays only "PS" on the LCD 133 as illustrated in FIG. 1C. The above-described action modes may include, for example, a world time display mode (a mode in which times-of-day of principal cities in the world is displayed) or a recall mode (a function to extract measured data) in addition to the above-described action mode.

The operating button B is a display switching button, and is a button configured to switch the display between the lap time (LAP) and the split time (SPL) in the chronograph mode (time measuring mode), for example.

The operating button C is a start/stop button, and is a button configured to instruct the start and the termination of a time measuring action in the chronograph mode, for example.

The operating button D is a flushing button of a light (internal illumination) and the operating button E is a button configured to save the lap time (LAP) and reset a measured value in the chronograph mode, for example.

Figure 1D:
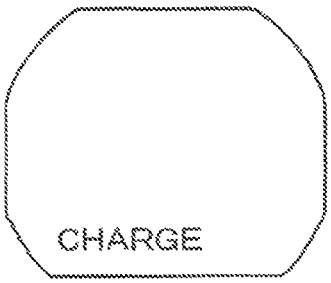
Figure 6:
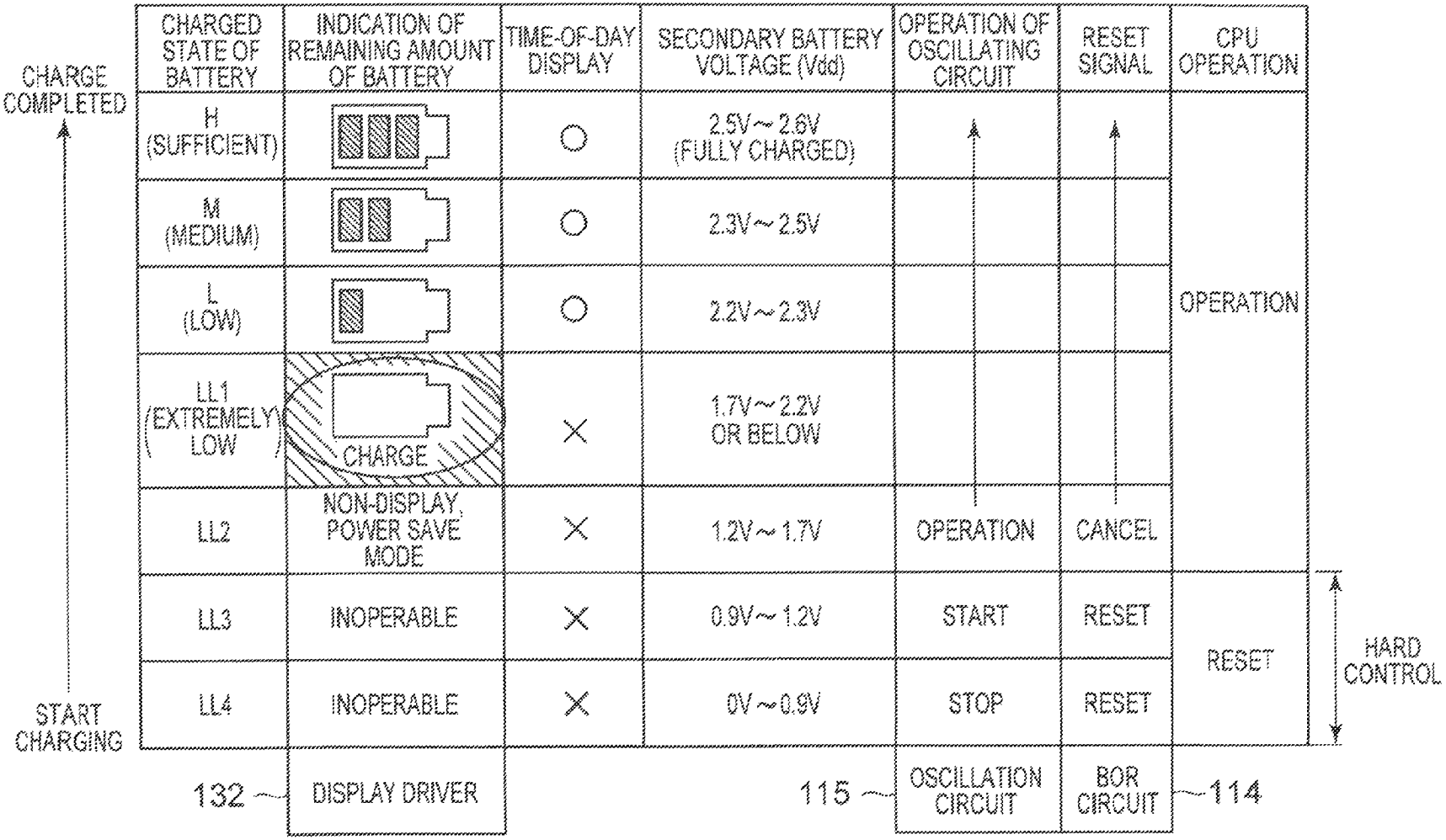
FIG. 6 is a drawing for explaining states of actions of respective parts according to a charged state of the secondary battery of the second embodiment.

The LCD 133 displays a remaining amount of battery indication 133A. The remaining amount of battery indication 133A changes the display mode according to the remaining amount of battery (more accurately, a secondary battery voltage). The remaining amount of battery indication 133A changes the display mode depending on whether the remaining amount of battery is H (sufficient), the remaining amount of battery is M (medium), the remaining amount of battery is L (low), or the remaining amount of battery is LL1 (extremely low) as illustrated in FIG. 6, for example. When the remaining amount of battery is LL1 (extremely low), as illustrated in FIG. 1D, a charge sign "CHARGE" which indicates the secondary battery needs charging (or is currently charging) is displayed.

The charge sign "CHARGE" which indicates that the secondary battery needs to be charged is not displayed in the electronic timepiece of the first embodiment, and is performed in the electronic timepiece of a second embodiment described later.

Internal Configuration of Electronic Timepiece

Figure 2:
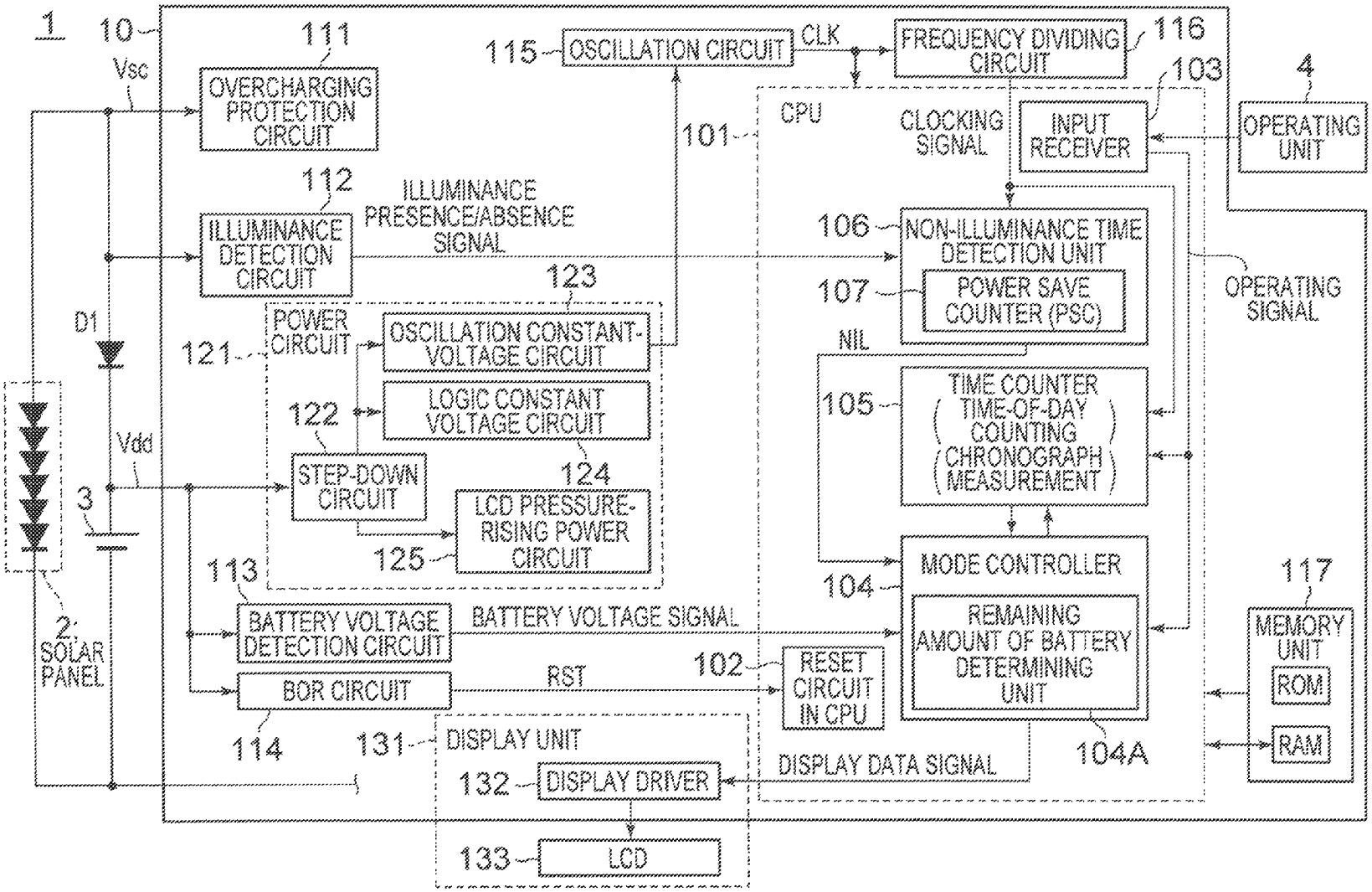
FIG. 2 is a block diagram illustrating an internal configuration of the electronic timepiece.

FIG. 2 is a block diagram illustrating an internal configuration of the electronic timepiece according to the embodiment of the invention, and illustrates an example of the electronic timepiece provided with the solar panel 2. The configuration of the electronic timepiece 1 of the first embodiment illustrated in FIG. 2 is common to the second embodiment described later, and the second embodiment is different from the first embodiment only in the contents displayed on an display unit 131 (presence or absence of the charge sign "CHARGE").

As illustrated in FIG. 2, the electronic timepiece 1 includes an electronic circuit provided in an integrated circuit 10 (Integrated Circuit; IC), the solar panel 2 including a plurality of solar battery cells, a diode D1, and a secondary battery 3. The electronic timepiece 1 includes the LCD 133 and an operating unit 4.

The integrated circuit 10 includes the CPU (Central Processing Unit) 101, an overcharging protection circuit 111, an illuminance detector 112, a battery voltage detection circuit 113, a BOR circuit 114, an oscillation circuit 115, a frequency dividing circuit 116, a memory 117, a power circuit 121, and a display unit 131.

The electronic timepiece 1 is configured to be driven by power supplied from the solar panel 2 via the secondary battery 3, and be capable of being activated and restored to a normal action reliably when the secondary battery 3 is restored from an uncharged state to a normally charging state (detail description will be given later).

Respective parts which constitute the electronic timepiece 1 will be described in detail.

The solar panel 2 includes the plurality of solar battery cells, and charges the secondary battery 3 by a generated voltage Vsc (output voltage) from the solar panel 2. The respective parts of the electronic timepiece 1 are operated upon reception of a supply of a secondary battery voltage Vdd (referred to also simply as "battery voltage Vdd") from the secondary battery 3, and various displays such as time-of-day display on the LCD 133 are performed.

The overcharging protection circuit 111 short-circuits both ends of the solar panel 2 by a switch, not illustrated when the secondary battery 3 is overcharged and reaches a predetermined voltage, for example, 2.6 V or higher. Accordingly, a generated power output from the solar panel 2 is not charged in the secondary battery 3, and the overcharging of the secondary battery 3 is prevented. Also, the electronic timepiece 1 prevents current to flow reversely from the secondary battery 3 to the solar panel 2 by a reverse flow preventing diode D1 when the both ends of the solar panel 2 are short-circuited, and when no light is incident on the solar panel 2.

The illuminance detection circuit 112 determines whether or not the generated voltage Vsc of the solar panel 2 is a sufficient voltage. When the generated voltage Vsc of the solar panel 2 is not a sufficient voltage and is equal to or lower than a predetermined threshold voltage, the illuminance detection circuit 112 determines that the solar cells which constitute the solar panel 2 are blocked, and hence there is no received illuminance (no incident light).

In contrast, when the generated voltage Vsc of the solar panel 2 is a sufficient voltage, the illuminance detection circuit 112 determines that the solar cells which constitute the solar panel 2 are not blocked and exceeds the predetermined threshold value, and hence there is received illuminance (incident light). The illuminance detection circuit 112 outputs an illuminance presence/absence signal indicating "with illuminance" or "without illuminance" to a no-illuminance time detector 106 in the CPU 101.

The battery voltage detection circuit 113 is a circuit for detecting the battery voltage Vdd of the secondary battery 3, and is configured to convert a voltage value of the battery voltage Vdd of the secondary battery 3 to a digital signal, and outputs the same to the mode controller 104 in the CPU 101 as a battery voltage signal. In the mode controller 104 in the CPU 101, whether or not the time-of-day display on the display unit 131 is to be performed, or the time-of-day display is brought into an extinguished state (power save mode) on the basis of the battery voltage signal is determined.

The BOR circuit 114 is a Brown-out reset circuit, which is configured to generate a reset signal RST and output the reset signal RST to the CPU 101 when the secondary battery voltage Vdd is lowered to a predetermined voltage or lower. The BOR circuit outputs the reset signal RST to the CPU 101 to brings the CPU 101 to a reset state when the secondary battery voltage Vdd is equal to or lower than 1.2 V (second voltage), and cancels the reset state of the CPU 101 by stopping an output of the reset signal RST when the secondary battery voltage Vdd exceeds 1.2 V.

The oscillation circuit 115 generates a clock signal CLK which becomes an action clock signal of the CPU 101 and an action reference of the respective parts. The frequency dividing circuit 116 divides the frequency of the clock signal CLK to generate a time-counting signal which is a reference signal for measuring time in the time-of-day counting action and the time measuring action (chronograph measuring action). The time-counting signal is output to a time counter 105 and the no-illuminance time detector 106.

The operating unit 4 includes a plurality of the operating buttons (see FIG. 1A) which may be operated by the user. In this operating unit 4, a signal according to a button operation is input to an input receiver 103 in the CPU 101 by the button operation performed by the user. The user is capable of performing switching of the action modes, switching of display contents, time-of-day alignment, and other various settings in the electronic timepiece 1 by operating the operating buttons of the operating unit 4.

The memory 117 includes a ROM (Read Only Memory) and a RAM (Random Access Memory). A procedure relating to the processing performed in the electronic timepiece 1 is stored in the ROM in a form of a program, and a process required in the electronic timepiece 1 is performed by the CPU 101 reading out and executing the stored program. The RAM is used as a memory for an operation performed when the CPU 101 executes the process. Various measurement data measured in the electronic timepiece are stored and saved in the memory 117. For example, data such as the lap time or the split time measured by the time measuring action in the chronograph mode is stored in the memory 117.

The memory 117 stores information on a predetermined transfer period (determination time when transferring to the power save mode, for example, 30 minutes) in the interior thereof. The transfer period may be set manually by the user through the operation of the operating buttons of the operating unit 4.

The power circuit 121 is a circuit configured to supply a power source required for the actions of the respective parts on the basis of the secondary battery voltage Vdd. The power circuit 121 includes a step-down circuit 122, an oscillation constant-voltage circuit 123, a logic constant voltage circuit 124, and an LCD pressure-rising power circuit 125.

The step-down circuit 122 is a circuit configured to lower the battery voltage Vdd once to a predetermined voltage.

The oscillation constant-voltage circuit 123 is a circuit configured to generate the power source required for driving the oscillation circuit 115, and outputs the voltage output from the step-down circuit 122 after having converted into a certain voltage required for driving the oscillation circuit 115. The oscillation circuit 115 starts oscillation upon reception of a supply of power from the oscillation constant-voltage circuit 123 and outputs a clock signal CLK when the secondary battery voltage Vdd is 0.9 V (first voltage) or higher as described later.

The logic constant voltage circuit 124 is a circuit configured to generate a power source required for driving a logic circuit (an electronic circuit that performs a logical operation) including the CPU 101 in the electronic timepiece 1, and outputs the voltage output from the step-down circuit 122 to a certain voltage required for driving the logic circuit.

The LCD pressure-rising power circuit 125 is a circuit configured to generate a power source required for driving the LCD 133 and outputs the voltage output from the step-down circuit 122 after having converted into a certain voltage required for driving the LCD 133.

The display unit 131 includes a display driver 132 and the LCD 133.

The display driver 132 inputs a display data signal in response to the respective action modes (for example, the time-of-day display mode or the chronograph mode) from the mode controller 104 in the CPU 101 and outputs the same to the LCD 133. For example, the display driver 132 inputs the display data signal corresponding to a time-of-day time-counting data from the mode controller 104, and displays the same on the LCD 133 in the time-of-day display mode. For example, the display driver 132 inputs a display data signal corresponding to a chronograph measuring data from the mode controller 104 and displays the same on the LCD 133 in the chronograph mode.

The display driver 132 is configured to extinguish the display of the LCD 133 when the electronic timepiece 1 is transferred to the power save mode and the display data signal showing that the electronic timepiece 1 is in the power save mode is output from the mode controller 104. When extinguishing the display of the LCD 133 in the power save mode, the display driver 132 displays a display (for example, "PS") indicating that the electronic timepiece 1 is in the power save mode on the LCD 133.

When it is determined that the remaining amount of battery of the secondary battery 3 is lowered in the mode controller 104 and the display data signal indicating that charging of the secondary battery 3 is necessary is output from the mode controller 104, the display driver 132 displays the charge sign, (for example, the charge sign "CHARGE") on the LCD 133. The charge sign "CHARGE" is displayed in the second embodiment, described later.

The LCD 133 composed of the liquid crystal display performs a display in response to the display data output from the display driver 132, for example, displays of the respective action modes, the time-of-day display, and a display of the remaining amount of the battery.

A CPU reset circuit 102 in the CPU 101 is configured to stop the action of the CPU 101 when the reset signal RST is input from the BOR circuit 114, and initialize the state of the respective parts (for example, counted values of a register or a counter) in the CPU 101.

The input receiver 103 receives the button operation signal input from the operating unit 4 as an external interruption request signal, stores the fact that the button operation is performed through the operating unit 4 and the content thereof in a register (not illustrated), and outputs an operation signal in response to the content of the button operation to the respective parts in the CPU 101.

For example, the input receiver 103 outputs the mode change signal from the operating unit 4 for changing the action mode of the electronic timepiece 1 to the mode controller 104 as the operation signal. The input receiver 103 outputs the operation signal to the time counter 105 for aligning the time-of-day or other various setting in the time counter 105.

The mode controller 104 is configured to set the action mode of the electronic timepiece 1 and controls actions of the time counter 105 and the no-illuminance time detector 106. The mode controller 104 sets the action mode in the electronic timepiece 1 in response to the operation signal output from the operating unit 4 (the operation signal in response to the mode change signal from the operating unit 4 for example). The mode controller 104 generates the display data signal and outputs the generated display data signal to the display driver 132 in order to display the display data in response to the action mode on the LCD 133.

The mode controller 104 inputs a signal indicating the no-illuminance duration NIL (a period in which no light is incident on the solar panel 2 continues) from the no-illuminance time detector 106 for the comparison with the predetermined transfer period. Then, the mode controller 104 transfers the mode of the electronic timepiece 1 to the power save mode when the no-illuminance duration NIL reaches the predetermined transfer period (for example, 30 minutes). When the mode is transferred to the power save mode, the mode controller 104 extinguishes the time-of-day display in the LCD 133, generates a display data signal for causing a display in response to the power save mode (for example, "PS"), and outputs the generated display data signal to the display driver 132.

The mode controller 104 determines the remaining amount of battery (more accurately, the magnitude of the secondary battery voltage Vdd) of the secondary battery 3 on the basis of a voltage signal input from the battery voltage detection circuit 113 by a remaining amount of battery determining unit 104A.

Then, the mode controller 104 transfers the mode of the electronic timepiece 1 to the power save mode when the secondary battery voltage Vdd is equal to or lower than a predetermined voltage value (for example, 2.2 V).

When the mode is transferred to the power save mode by the lowering of the remaining amount of battery, the mode controller 104 outputs the display data signal indicating the fact that the remaining amount of battery is lowered to the display driver 132.

The display driver 132 having received the display data signal indicating the fact that the remaining amount of battery is lowered extinguishes the time-of-day display on the LCD 133 and performs a display indicating that the secondary battery 3 needs to be charged (for example, flushing of a charge sign "CHARGE") in a desired case (the case of the second embodiment described later).

In this case, the display driver 132 may be configured to display the display indicating the power save mode "PS" as well as extinguishing the time-of-day display on the LCD 133.

The time counter 105 counts the time-counting signal input from the frequency dividing circuit 116 to perform the time-of-day counting, and generates the time-counting data which is a signal indicating the time-of-day. The time counter 105 counts the time-counting signal input from the frequency dividing circuit 116 to perform the time-counting action, and generates the time-counting data. The time-of-day counting data and the time measuring data generated by the time counter 105 is output to the mode controller 104.

The no-illuminance time detector 106 inputs the illuminance presence/absence signal from the illuminance detector 112. The no-illuminance time detector 106 measures the no-illuminance duration NIL in which a state in which no light is incident on the solar panel continues. The counting of the no-illuminance duration NIL is performed by counting a cycle signal (for example, a cycle signal per minute) generated on the basis of the time-counting signal input from the frequency dividing circuit 116 by a power save counter (PSC) 107. Then, the no-illuminance time detector 106 outputs a signal indicating the measured no-illuminance duration NIL to the mode controller 104.

In the electronic timepiece 1 configured as described above, the operation signal for changing the action mode in the electronic timepiece 1 (in this case an operation signal corresponding to the mode change signal from an operating unit 143) is output to the mode controller 104 by the user operating the operating unit 4, for example, operating the operating button A (see FIG. 1). The mode controller 104 changes the action mode of the electronic timepiece 1 in response to the mode change signal. The action modes of the electronic timepiece 1 include, for example, as illustrated in FIG. 1B described above, the time-of-day display mode, the chronograph mode, the timer mode, and the alarm mode.

In the time-of-day display mode, the time counter 105 counts the time-counting signal output from the frequency dividing circuit 116, generates the time-of-day counting data which indicates the time-of-day, and outputs the time-of-day counting data to the mode controller 104. In the chronograph mode, the time counter 105 counts the time-counting signal output from the frequency dividing circuit 116, generates the time measuring data, and outputs the time measuring data to the mode controller 104.

When the electronic timepiece 1 is set to the time-of-day display mode, the mode controller 104 outputs the display data signal including the time-of-day counting data to the display driver 132. The display driver 132 outputs the time-of-day counting data to the LCD 133 after having converted to a form suitable for display, and the LCD 133 displays the time of day corresponding to the time-of-day counting data digitally.

When the electronic timepiece 1 is set to the chronograph mode, the mode controller 104 outputs the display data signal including the time measuring data to the display driver 132. The display driver 132 outputs the time measuring data to the LCD 133 after having converted to a form suitable for display, and the LCD 133 displays the time corresponding to the time measuring data digitally.

The no-illuminance time detector 106 inputs the illuminance presence/absence signal from the illuminance detection circuit 112 and measures the no-illuminance duration NIL in which the state in which no light is incident on the solar panel continues by the power save counter (PSC) 107. Then, the no-illuminance time detector 106 outputs the measured no-illuminance duration NIL to the mode controller 104.

The mode controller 104 inputs a signal indicating the no-illuminance duration NIL from the no-illuminance period detector 106.

Then, the mode controller 104 transfers the mode of the electronic timepiece 1 to the power save mode when the no-illuminance duration NIL reaches the predetermined transfer period (for example, 30 minutes). When the mode is transferred to the power save mode, the mode controller 104 generates the display data signal for causing the display in response to the power save mode, and outputs the generated display data signal to the display driver 132. When the display data signal corresponding to the power save mode is input from the mode controller 104, the display driver 132 extinguishes the time-of-day display on the LCD 133, and displays a sign indicating that the electronic timepiece 1 is in the power save state (for example, "PS").

The mode controller 104 determines the remaining amount of battery (more accurately, the magnitude of the battery voltage) of the secondary battery 3 on the basis of the voltage signal input from the battery voltage detection circuit 113 by the remaining amount of battery determining unit 104A. For example, as illustrated in FIG. 4, whether the remaining amount of battery is either H (sufficient), M (medium), L (low), LL1 or LL2 is determined. The mode controller 104 generates a display data signal for performing the time-of-day display and the remaining amount of battery display when the remaining amount of battery is H (sufficient), M (medium), and L (low), and outputs the generated signal to the display driver 132.

When the display data signal for performing the time-of-day display and the remaining amount of battery display is input from the mode controller 104, the display driver 132 displays the time-of-day display and the remaining amount of battery display on the LCD 133. The remaining amount of battery display corresponds to the charged state of the secondary battery 3 including H (sufficient), M (medium), and L (low) as illustrated in FIG. 4.

Description about Restoration Action from Uncharged State to Charged State of Secondary Battery The electronic timepiece 1 having the configuration as described above is configured to be capable of restoring the secondary battery 3 in an uncharged state (vacant state) to the charged state smoothly even when the solar panel 2 is under a low illumination and a generated current is low as under a state in which the electronic timepiece 1 is under fluorescent lighting conditions to reliably restore the electronic timepiece 1 from the operation stopped state to a normally operating state. Therefore, the electronic timepiece 1 is activated when the charging state is restored by following the procedure shown in FIG. 3.

Figure 3:
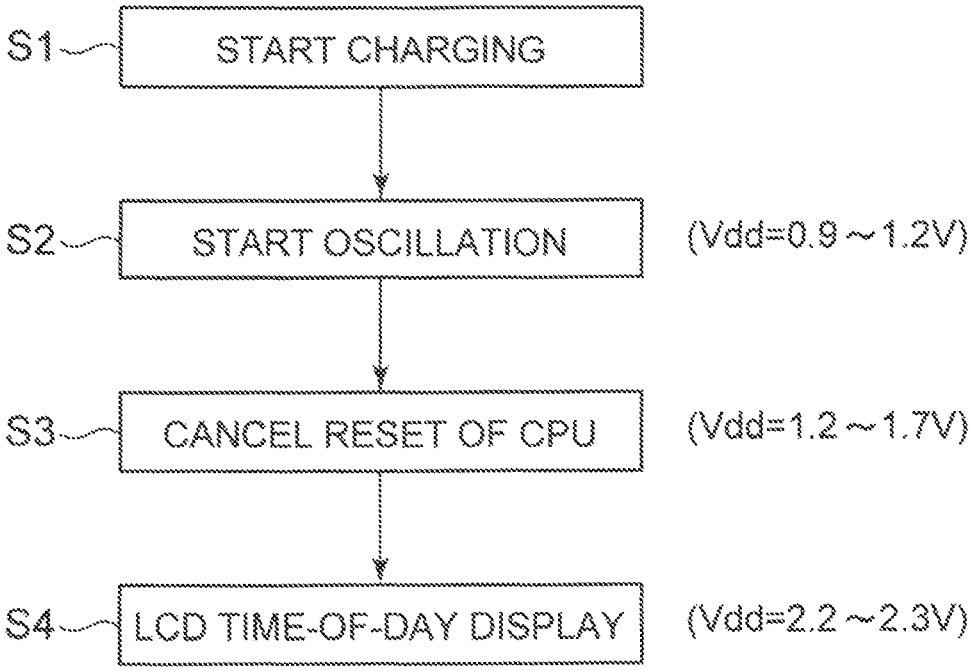
FIG. 3 is a drawing showing a flow of an activating operation of the electronic timepiece of a first embodiment at the time of restoration of a battery voltage.

FIG. 3 is a drawing showing a flow of an activating operation of the electronic timepiece 1 at the time of restoration of the battery voltage. Referring now to the FIG. 3, a procedure of recharging the secondary battery 3 in the uncharged state by the generated current from the solar panel 2 and activating the electronic timepiece 1 to start the operation will be described.

First of all, the electronic timepiece 1 is placed under a low illumination such as under a fluorescent lighting condition, and charging of the secondary battery 3 in the uncharged state is started (Step S1).

Then, when the secondary battery 3 is gradually charged by the generated current from the solar panel 2, and the secondary battery voltage Vdd reaches a point in the vicinity of 0.9 V, the power source required for an oscillating action is supplied from the power circuit 121 to the oscillation circuit 115, and output of the clock signal CLK from the oscillation circuit 115 is started (Step S2).

Subsequently, charging of the secondary battery 3 from the solar panel 2 is further proceeded, and when the secondary battery voltage Vdd reaches a point in the vicinity of 1.2 V, the reset state of the CPU 101 is cancelled (Step S3).

Subsequently, charging of the secondary battery 3 from the solar panel 2 is further proceeded, and when the secondary battery voltage Vdd reaches a point in the vicinity of 2.2 V, the time-of-day display on the LCD 133 of the display unit 131 is started (Step S4).

In this manner, in the electronic timepiece 1 of the embodiment, even when the cancellation of the reset of the CPU 101 is performed, the time-of-day display is not started immediately, and the time-of-day display is performed after the secondary battery voltage Vdd has reached 2.2 V. Therefore, The electronic timepiece 1 is configured to be capable of restoring the secondary battery 3 in the uncharged state (vacant state) to the normally charged state smoothly even when the solar panel 2 is under the low illumination and the generated current is low, so that the restoration of the electronic timepiece 1 from the operation stopped state to the normally operating state is ensured.

FIG. 4 is a drawing for explaining an operation state of the respective parts according to the charged state of the secondary battery 3 of the first embodiment. FIG. 4 is a table showing the charged state of the secondary battery 3 in seven states of H (sufficient), M (medium), L (low), LL1 (extremely low) LL2, LL3, and LL4, and the states of operation of the display driver 132, the oscillation circuit 115, the BOR circuit 114, and the CPU 101 in response to the respective charged states.

In the table shown in FIG. 4, when the charging of the secondary battery 3 is started, the charging of the secondary battery 3 is progressed with time, and the charged state of the secondary battery 3 is brought firstly into the state of LL4 on the lowermost row. Subsequently, when the charging of the secondary battery 3 is progressed, the secondary battery 3 proceeds through the respective charged states in the order of "LL4→LL3→LL2→LL1→L→M→H".

The state of LL4 shown in the lowest row is a low level state in which the secondary battery voltage Vdd is "0 to 0.9 V". In the state of LL4, the power voltage required for driving the LCD 133 is not supplied from the power circuit 121 to the display driver 132, and the LCD 133 is in an inoperable state, so that the LCD 133 is in the extinguished state.

In the oscillation circuit 115, the power voltage required for performing the oscillating action is not supplied from the power circuit 121, and the oscillation circuit 115 is in the state in which the output of the clock signal CLK is stopped.

The BOR circuit outputs the reset signal RST, and the CPU 101 is in the reset state. Therefore, in the state of LL4, the electronic timepiece 1 is in the inoperable state.

Subsequently, the charging of the secondary battery 3 is progressed with time, and the secondary battery 3 is brought into the state of LL3. This state of LL3 is a state in which the secondary battery voltage Vdd is in "0.9 to 1.2 V". In the state of LL3, the power voltage required for driving the LCD 133 is not supplied from the power circuit 121 to the display driver 132, and the LCD 133 is in the inoperable state, so that the LCD 133 is in the extinguished state.

In contrast, in the oscillation circuit 115, the power voltage required for performing the oscillating action is supplied from the power circuit 121, and the oscillation circuit 115 starts the output of the clock signal CLK.

However, the BOR circuit outputs the reset signal RST, and the CPU 101 is still in the reset state. Therefore, in the state of LL3, the electronic timepiece 1 is in the inoperable state.

In the state of LL4 and LL3, the CPU 101 is in the reset state, and all of the actions in the LL4 and LL3 are performed by a hardware control.

Subsequently, the charging of the secondary battery 3 is progressed with time, and the secondary battery 3 is brought into the state of LL2. This state of LL2 is a state in which the secondary battery voltage Vdd is in "1.2 to 1.7 V". In this state of LL2, the oscillation circuit 115 outputs the clock signal CLK, and the BOR circuit cancels the output of the reset signal RST, and the reset of the CPU 101 is cancelled and the action is started.

Therefore, in this state of LL2, when the power voltage required for driving the LCD 133 is supplied from the power circuit 121 to the display driver 132 by a soft processing, the electronic timepiece 1 is brought into a state in which the time-of-day display is enabled. However, the charged voltage of the secondary battery 3 is still low, and the CPU 101 is transferred to the power save mode in order to reduce the power consumption of the secondary battery 3 to bring the LCD 133 to an extinguished state.

The transfer of the mode to the power save mode in the state of LL2 is performed by determining the voltage value of the secondary battery voltage Vdd by the remaining amount of battery determining unit 104A in the mode controller 104. Then, the mode controller 104 transfers the mode of the electronic timepiece 1 to the power save mode when the secondary battery voltage Vdd is in the state of "1.2 to 1.7 V".

Subsequently, the charging of the secondary battery 3 is progressed with time, and the secondary battery 3 is brought into the state of LL1. This state of LL1 is a state in which the secondary battery voltage Vdd is in "1.7 to 2.2 V". In the state of LL1, the power voltage required for driving the LCD 133 by the soft processing is supplied from the power circuit 121 to the display driver 132.

The oscillation circuit 115 outputs the clock signal CLK, and the BOR circuit cancels the output of the reset signal, and the CPU 101 is cancelled from being reset and hence is operated.

Therefore, in this state of LL1, the electronic timepiece 1 is brought into the state in which the time-of-day display is enabled. However, the charged voltage of the secondary battery 3 is still low, and the power consumption of the secondary battery 3 is reduced in the same manner as in the case of the LL2, so that the CPU 101 is transferred to the power save mode to bring the LCD 133 into the extinguished state.

Subsequently, the charging of the secondary battery 3 is progressed with time, and the secondary battery 3 is brought into the state of L (low). This state of L is a state in which the secondary battery voltage Vdd is in "2.2 to 2.3 V". In the state of L, the sufficient power voltage for driving the LCD 133 is supplied from the power circuit 121 to the display driver 132.

The oscillation circuit 115 outputs the clock signal CLK, and the CPU 101 is in operation.

In the state of L (low), the secondary battery voltage Vdd is increased to or above 2.2 V, and hence is capable of performing the time-of-day display by driving the LCD 133. Therefore, the mode controller 104 transfers the electronic timepiece 1 to a normal mode, and outputs the display data signal indicating the time-of-day display and the remaining amount of battery to the display driver 132. The display driver 132 drives the display LCD 133 and performs the time-of-day display and the remaining amount of battery display.

Subsequently, the charging of the secondary battery 3 is progressed with time, and the secondary battery 3 is brought into the state of M (medium). The state of M is a state in which the secondary battery voltage Vdd is in "2.3 to 2.5 V".

In the state of M (medium), the secondary battery voltage Vdd is increased to or above 2.3 V, and the display driver 132 performs the time-of-day displays and the remaining amount of battery display on the LCD 133 as in the case of L (low).

Subsequently, the charging of the secondary battery 3 is progressed with time, and the secondary battery 3 is brought into the state of H (sufficient). This state of H is a state in which the secondary battery voltage Vdd is in "2.5 to 2.6 V (full charge)".

In the state of H (sufficient), the secondary battery voltage Vdd is increased to or above 2.5 V, and the display driver 132 performs the time-of-day displays and the remaining amount of battery display on the LCD 133 as in the case of M (medium).

The above-described 2.6 V is a voltage at which the overcharging protection circuit 111 starts protecting operation, and the charged voltage Vdd of the secondary battery 3 is limited so as not to reach the solar panel 2.6 V.

In the above-described H state, M state, and L state, if the state in which no light is incident on the solar panel 2 continues, the electronic timepiece 1 detects the duration thereof as the no-illuminance duration NIL by the no-illuminance time detector 106. Then, the electronic timepiece 1 compares the no-illuminance duration NIL with the predetermined transfer period (for example, 30 minutes) by the mode controller 104, and when the no-illuminance duration NIL reaches the above-described transfer period (for example, 30 minutes), the electronic timepiece 1 is transferred to the power save mode, and stops the time-of-day display of the LCD 133.

As described above, the electronic timepiece 1 of the embodiment sets an operation start voltage (1.2 V) at which the electronic timepiece 1 is activated and starts an operation to be lower than a display start voltage (2.2 V) at which the display action in the display unit 131 is started. Accordingly, the electronic timepiece 1 capable of restoring a secondary battery 3 in an uncharged state or a low charged state to a normal charged state smoothly and reliably restoring the electronic timepiece from an operation stopped state to a normally operating state even though a generated current from the solar panel 2 is insufficient such as a case where the electronic timepiece 1 is under a fluorescent lighting condition is provided.

Second Embodiment

The electronic timepiece 1 of the first embodiment described above is configured to wait until the secondary battery voltage Vdd is restored to 2.2 V after having started the charging to the secondary battery 3 in the uncharged state, and then perform the time-of-day display.

In other words, in the electronic timepiece 1 of the first embodiment, the state in which nothing is displayed on the LCD 133 continues for a long time until the secondary battery voltage Vdd reaches 2.2 V after having started the charging to the secondary battery 3. Therefore, the user of the electronic timepiece 1 may misunderstand that the electronic timepiece 1 is broken because nothing is displayed on the LDC for a long time even though the charging is started.

Therefore, in the second embodiment of the invention, an example in which the charge sign (for example, the charge sign "CHARGE") is displayed when the charged voltage Vdd of the secondary battery 3 is between 1.7 V and 2.2 V will be described.

Figure 5:
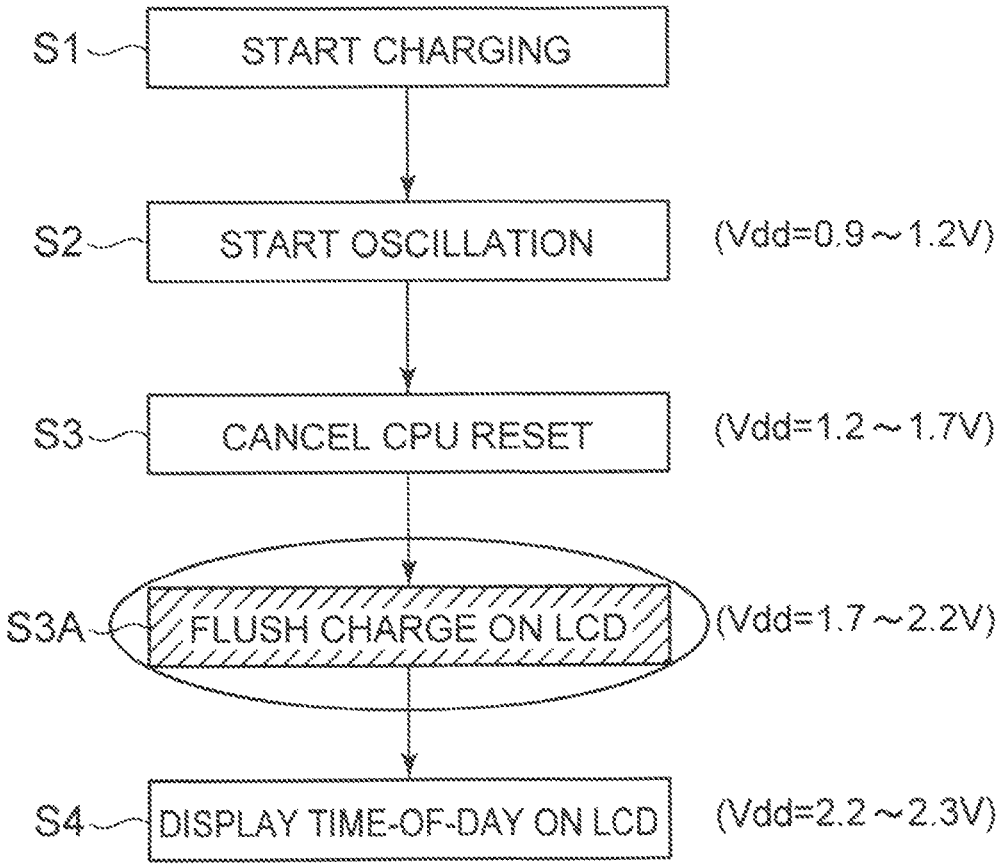
FIG. 5 is a drawing showing a flow of an activating operation of the electronic timepiece of a second embodiment at the time of restoration of a battery voltage.

FIG. 5 is a drawing showing a flow of an activating operation of the electronic timepiece of the second embodiment at the time of restoration of a battery voltage. FIG. 5 is different from the flow of the activating operation of the first embodiment shown in FIG. 3 only in that the process in Step S3A (a portion surrounded by an oval) is newly added. Therefore, in FIG. 5, the same process steps as those in FIG. 3 are designated by the same step number, and overlapped description will be omitted.

As shown in FIG. 5, after having started the charge to the secondary battery 3, the charge sign "CHARGE" is flushed at the charged voltage Vdd of the secondary battery 3 between 1.7 V to 2.2 V.

FIG. 6 is a drawing for explaining states of actions of respective parts according to the charged state of the secondary battery 3 of the second embodiment. FIG. 6 is different from the table of the states of actions of the first embodiment shown in FIG. 4 only in that the charge sign (the portion surrounded by an oval) is newly added to the remaining amount of battery display in the state of LL1. Other portions are the same as those in the table of the states of actions of the first embodiment shown in FIG. 4.

As shown in FIG. 6, after having started the charging to the secondary battery 3, the charge sign "CHARGE" is flushed at the charged voltage Vdd of the secondary battery 3 between 1.7 V to 2.2 V.

In this manner, in the second embodiment, since the fact that the electronic timepiece 1 is being charged can be notified to the user by flushing the charge sign "CHARGE" when the charged voltage Vdd of the secondary battery 3 is between 1.7 V to 2.2 V, the user can confirm that the electronic timepiece 1 is not broken.

Although the embodiment of the invention has been described thus far, the correspondence of the invention with respect to the above-described embodiment will be additionally described here.

In the embodiments described above, the electronic timepiece 1 corresponds to an electronic timepiece of the invention, and the CPU 101 corresponds to the CPU of the invention. A voltage 1.2 V corresponds to a predetermined operation start voltage of the invention, the voltage (2.2 V) at which the time-of-day display is started in the first embodiment described above and the voltage (1.7 V) at which the charge sign "CHARGE" is started in the second embodiment described above correspond to a predetermined display start voltage of the invention.

The oscillation circuit 115 corresponds to an oscillation circuit of the invention, the BOR circuit 114 corresponds to a reset circuit of the invention, the display unit 131 corresponds to a display unit of the invention, and the battery voltage detection circuit 113 corresponds to a battery voltage detection circuit of the invention.

A voltage of 0.9 V corresponds to a first voltage of the invention, a voltage 1.2 V corresponds to a second voltage of the invention, a voltage of 2.2 V corresponds to a third voltage of the invention, and a voltage of 1.7 V corresponds to a fourth voltage of the invention.

The electronic timepiece 1 of the embodiments described above is the electronic timepiece 1 configured to be operated by power supplied from the secondary battery 3 which is charged by the generated voltage from the solar panel 2 configured to perform power generation upon reception of light, includes a predetermined operation start voltage (1.2 V) at which the electronic timepiece 1 is activated and starts operation, and a predetermined display start voltage (1.7 V or 2.2 V) configured to start the display action of the display unit 131 in response to the battery voltage Vdd of the secondary battery 3, and the operation start voltage (1.2 V) is set to be lower than the display start voltage (1.7 V or 2.2 V).

In the electronic timepiece 1 having such a configuration, the battery voltage Vdd at which the electronic timepiece 1 is activated and start an operation is set to 1.2 V, and the battery voltage Vdd at which the electronic timepiece 1 starts the time-of-day display on the display unit 131 is 1.7 V or 2.2 V. In other words, the electronic timepiece 1 starts the display action on the display unit 131 which consumes significant power after having restored the charged voltage of the secondary battery 3 sufficiently when the charging state of the secondary battery 3 is restored.

Accordingly, the electronic timepiece 1 is capable of restoring the secondary battery 3 in the uncharged state or the low charged state to the normal charged state smoothly even though the generated current from the solar panel 2 is insufficient such as a case where the electronic timepiece 1 is under a fluorescent. Accordingly, the electronic timepiece 1 is capable of reliably restoring the electronic timepiece 1 from the operation stopped state to the normally operating state.

In the embodiments described above, the electronic timepiece 1 includes the CPU 101 configured to control the time-counting and display action of the electronic timepiece 1, the oscillation circuit 115 configured to generate the clock signal CLK when the secondary battery voltage Vdd is equal to or higher than the predetermined first voltage (0.9 V) and supply the generated clock signal CLK to the CPU 101, the BOR circuit 114 configured to reset the CPU 101 when the secondary battery voltage Vdd is equal to or lower than the predetermined second voltage (1.2 V) higher than the first voltage (0.9 V) and cancel the reset of the CPU 101 when the secondary battery voltage Vdd exceeds the second voltage (1.2 V), the display unit 131 configured to perform the display upon reception of a supply of power from the secondary battery 3, and the battery voltage detection circuit 113 configured to detect the voltage value of the secondary battery voltage Vdd and output the detected voltage value to the CPU 101. The CPU 101 starts operation when the secondary battery voltage Vdd exceeds the second voltage (1.2 V) and the reset is cancelled, and performs the time-of-day display on the display unit 131 when the secondary battery voltage Vdd is equal to or higher than the predetermined third voltage (2.2 V) which is higher than the second voltage (1.2 V).

In the electronic timepiece 1 having such a configuration, in a case where the charging to the secondary battery 3 in the uncharged state is started, an output of the clock signal CLK from the oscillation circuit 115 is started when the battery voltage Vdd reaches the first voltage (0.9 V), and the reset state of the CPU 101 is cancelled when the secondary battery voltage Vdd reaches the second voltage (1.2 V). Subsequently, when the secondary battery voltage Vdd reaches the third voltage (2.2 V), the time-of-day display on the display unit 131 is started. In this manner, in the electronic timepiece 1 of the embodiments, even when the secondary battery voltage Vdd reaches the second voltage (1.2 V) and the cancellation of the reset of the CPU 101 is performed, the time-of-day display is not started immediately, and the time-of-day display is performed after the secondary battery voltage Vdd has reached the third voltage (2.2 V). Therefore, The electronic timepiece 1 is configured to be capable of restoring the secondary battery 3 in the uncharged state (vacant state) smoothly even when the solar panel 2 is under the low illumination and the generated current is low, so that the restoration of the electronic timepiece 1 from the operation stopped state to the normally operating state is ensured.

In the embodiments described above, the CPU 101 extinguishes the time-of-day display on the display unit 131 and displays the sign indicating that the secondary battery 3 needs to be charged (for example, the charge sign "CHARGE") on the display unit 131 when the secondary battery voltage Vdd is equal to or higher than the predetermined fourth voltage (1.7 V) which is a voltage between the second voltage (1.2 V) and the third voltage (2.2 V), and is lower than the third voltage (2.2 V).

In the electronic timepiece 1 having such a configuration, in a case where the charging of the secondary battery 3 in the uncharged state is started, the sign indicating that the secondary battery 3 needs to be charged (for example, charge sign "CHARGE") on the display unit 131 is performed when the battery voltage Vdd is between the fourth voltage (1.7 V) to the third voltage (2.2 V). In other words, in the electronic timepiece 1, the charge sign ("CHARGE") is displayed in a stage before the secondary battery voltage Vdd reaches 2.2 V and the time-of-day display on the display unit 131 is performed.

Accordingly, the user of the electronic timepiece 1 is prevented from misunderstanding that the electronic timepiece 1 is broken because nothing is displayed for a long time on the LCD 133 after having started the charging of the electronic timepiece 1.

Although the embodiments of the invention have been described thus far, the electronic timepiece of the invention is not limited to the illustrated examples, and various modifications may be made without departing the scope of the invention as a matter of course.

What is claimed is:

1. An electronic timepiece configured to be operated by power supplied from a secondary battery that is charged with a voltage from a solar panel configured to generate electric power upon reception of light, the electronic timepiece comprising:

a display unit configured to perform display upon reception of a supply of electric power from the secondary battery;

a CPU configured to control time counting and the display by the display unit;

an oscillation circuit configured to generate a clock signal and to supply the generated clock signal to the CPU when a voltage of the secondary battery charged by the solar panel is equal to or higher than a predetermined first voltage; and a reset circuit configured to reset the CPU when the voltage of the secondary battery charged by the solar panel is equal to or lower than a predetermined second voltage higher than the first voltage, and to cancel reset of the CPU when the voltage of the second battery exceeds the second voltage in the case that the oscillation circuit generates the clock signal;

wherein the CPU is configured to start an operation when the voltage of the secondary battery charged by the solar panel exceeds the second voltage and the reset is cancelled, and to perform a time-of-day display on the display unit when the voltage of the secondary battery charged by the solar panel is equal to or higher than a predetermined third voltage higher than the second voltage.

2. The electronic timepiece according to claim 1, further comprising:

a battery voltage detection circuit configured to detect a voltage value of the secondary battery corresponding to the first, second and third voltage values and to output the detected voltage value to the CPU.

3. The electronic timepiece according to claim 2, wherein the CPU is further configured to stop performing the time-of-day display on the display unit and to perform a display on the display unit of an indication notifying that the secondary battery needs to be charged when the secondary battery voltage reaches or exceeds a predetermined fourth voltage having a voltage value between the second voltage and the third voltage and being lower than the third voltage.

4. The electronic timepiece according to claim 2, wherein the CPU controls the display unit to perform the time-of-day display and to display an indication of a remaining amount of charge in the secondary battery according to the voltage value of the secondary battery when the voltage of the secondary battery is equal to or higher than the third voltage.

5. The electronic timepiece according to claim 3, wherein the CPU controls the display unit to perform the time-of-day display and to display an indication of a remaining amount of charge in the secondary battery according to the voltage value of the secondary battery when the voltage of the secondary battery is equal to or higher than the third voltage.

6. The electronic timepiece according to claim 1, wherein the CPU is further configured to stop performing the time-of-day display on the display unit and to perform a display on the display unit of an indication notifying that the secondary battery needs to be charged when the secondary battery voltage reaches or exceeds a predetermined fourth voltage having a voltage value between the second voltage and the third voltage and being lower than the third voltage.

7. The electronic timepiece according to claim 1, wherein the CPU controls the display unit to perform the time-of-day display and to display an indication of a remaining amount of charge in the secondary battery according to the voltage value of the secondary battery when the voltage of the secondary battery is equal to or higher than the third voltage.

8. An electronic timepiece comprising:

a secondary battery;

a solar panel for generating electric power by light incident on the solar panel and for charging the secondary battery with an output voltage so that the electronic timepiece is operated with a power-supply voltage supplied from the solar panel through the secondary battery;

a display unit that receives a supply of electric power form the secondary battery to perform a display operation;

a CPU that controls time counting and controls the display unit to perform a display;

a battery voltage detection circuit that detects a voltage of the secondary battery charged by the solar panel;

an oscillation circuit that generates a clock signal and supplies the generated clock signal to the CPU when the voltage of the secondary battery detected by the battery voltage detection circuit reaches a predetermined first voltage; and a reset circuit that outputs a reset signal to the CPU to bring the CPU to a reset state when the voltage of the secondary battery detected by the battery voltage detection circuit is equal to or lower than a predetermined second voltage higher than the predetermined first voltage, and that cancels the reset state of the CPU by stopping an output of the reset signal when the voltage of the secondary battery detected by the battery voltage detection circuit exceeds the predetermined second voltage;

wherein the CPU controls the display unit to start a time-of-day display when the voltage of the secondary battery detected by the battery voltage detection circuit reaches a predetermined third voltage higher than the predetermined second voltage.

9. The electronic timepiece according to claim 8, wherein the battery voltage detection circuit is configured to detect the first, second and third predetermined voltages.

10. The electronic timepiece according to claim 8, wherein the CPU controls the display unit to stop the time-of-day display and to display an indication notifying that the secondary battery needs to be charged when the voltage of the secondary battery detected by the battery voltage detection circuit reaches a predetermined fourth voltage having a voltage value between that of the second and third predetermined voltages.

11. The electronic timepiece according to claim 10, wherein the CPU controls the display unit to perform the time-of-day display and to display an indication of a remaining amount of charge in the secondary battery when the voltage of the secondary battery detected by the battery voltage detection circuit is equal to or greater than the predetermined third voltage.

12. The electronic timepiece according to claim 8, wherein the CPU controls the display unit to perform the time-of-day display and to display an indication of a remaining amount of charge in the secondary battery when the voltage of the secondary battery detected by the battery voltage detection circuit is equal to or greater than the predetermined third voltage.

* * * * *